US009046013B2

(12) United States Patent
Lichti

(10) Patent No.: US 9,046,013 B2
(45) Date of Patent: Jun. 2, 2015

(54) CAMSHAFT PHASE

(71) Applicant: DELPHI TECHNOLOGIES, INC., Troy, MI (US)

(72) Inventor: Thomas H. Lichti, Victor, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 14/043,025

(22) Filed: Oct. 1, 2013

(65) Prior Publication Data

US 2015/0090207 A1 Apr. 2, 2015

(51) Int. Cl.
*F01L 1/34* (2006.01)
*F01L 1/344* (2006.01)

(52) U.S. Cl.
CPC ..... *F01L 1/344* (2013.01)

(58) Field of Classification Search
CPC ..... F01L 1/344
USPC ..... 123/90.15, 90.17, 90.31
See application file for complete search history.

(56) References Cited

U.S. PATENT DOCUMENTS 7,421,989 B2 9/2008 Fischer et al.
7,841,310 B2 * 11/2010 Child ..... 123/90.15
8,056,519 B2 11/2011 Cuatt et al.

OTHER PUBLICATIONS

Pending U.S. Appl. No. 13/667,127, filed Nov. 2, 2012.

* cited by examiner

*Primary Examiner* — Zelalem Eshete
(74) *Attorney, Agent, or Firm* — Thomas N. Twomey

(57) ABSTRACT

A camshaft phaser for controllably varying the phase relationship between a crankshaft and a camshaft in an internal combustion engine includes stator having a plurality of lobes. A rotor is coaxially disposed within the stator and has a plurality of vanes interspersed with the lobes defining alternating advance chambers and retard chambers. A lock pin is disposed within the rotor for selective engagement with a lock pin seat for preventing a change in phase relationship between the rotor and the stator. A lock pin oil control valve is located within the camshaft phaser for 1) selectively receiving the pressurized oil from one of the advance chambers and directing the pressurized oil to the lock pin and 2) selectively receiving the pressurized oil from one of the retard chambers and directing the pressurized oil to the lock pin for disengaging the lock pin from the lock pin.

14 Claims, 12 Drawing Sheets

CAMSHAFT PHASE

TECHNICAL FIELD OF INVENTION

The present invention relates to a hydraulically actuated camshaft phaser for varying the phase relationship between a crankshaft and a camshaft in an internal combustion engine; more particularly to such a camshaft phaser that is a vane-type camshaft phaser; even more particularly to a vane-type camshaft phaser which includes a lock pin for preventing change in phasing relationship at a position between a full advance position and a full retard position, and still even more particularly to such a van-type camshaft phaser which includes a lock pin valve therein for controlling the lock pin.

BACKGROUND OF INVENTION

A typical vane-type camshaft phaser for changing the phase relationship between a crankshaft and a camshaft of an internal combustion engine generally comprises a plurality of outwardly-extending vanes on a rotor interspersed with a plurality of inwardly-extending lobes on a stator, forming alternating advance and retard chambers between the vanes and lobes. Engine oil is selectively supplied to one of the advance and retard chambers and vented from the other of the advance and retard chambers in order to rotate the rotor within the stator and thereby change the phase relationship between an engine camshaft and an engine crankshaft. Camshaft phasers also commonly include an intermediate lock pin which selectively prevents relative rotation between the rotor and the stator at an angular position that is intermediate of a full advance and a full retard position. The intermediate lock pin is engaged and disengaged by venting oil from the intermediate lock pin and by supplying pressurized oil to the intermediate lock pin respectively.

Some camshaft phasers use a phasing oil control valve to selectively supply and vent oil to and from the advance chambers and the retard chambers in order to control the phasing function of the camshaft phaser while a separate lock pin oil control valve is used to selectively supply and vent oil to and from the lock pin in order to control the lock pin function of the camshaft phaser, thereby allowing the phasing function and the lock pin function to be controlled independently of each other. U.S. patent application Ser. No. 13/667,127 to Lichti et al., the disclosure of which is incorporated herein by reference in its entirety, teaches a camshaft phaser which uses a phasing oil control valve that is external to the camshaft phaser and a lock pin oil control valve that is located within the camshaft phaser. Lichti et al. teaches that this arrangement allows for a more axially compact camshaft bearing compared to a camshaft phaser in which both the phasing oil control valve and the lock pin oil control valve are located external to the camshaft phaser. While the camshaft phaser of Lichti et al. may effectively allow for a more axial compact camshaft bearing, a separate dedicated oil supply is needed to supply oil to the lock pin oil control valve that is located within the camshaft phaser.

What is needed is camshaft phaser which minimizes or eliminates one or more the shortcomings as set forth above.

SUMMARY OF THE INVENTION

Briefly described, a camshaft phaser is provided for controllably varying the phase relationship between a crankshaft and a camshaft in an internal combustion engine. The camshaft phaser includes stator having a plurality of lobes and connectable to the crankshaft of the internal combustion engine to provide a fixed ratio of rotation between the stator and the crankshaft; a rotor coaxially disposed within the stator and having a plurality of vanes interspersed with the lobes defining alternating advance chambers and retard chambers, wherein the advance chambers receive pressurized oil in order to change the phase relationship between the crankshaft and the camshaft in an advance direction and the retard chambers receive the pressurized oil in order to change the phase relationship between the camshaft and the crankshaft in a retard direction; a lock pin disposed within one of the rotor and the stator for selective engagement with a lock pin seat for preventing a change in phase relationship between the rotor and the stator at a predetermined aligned position of the rotor relative to the stator; and a lock pin oil control valve within the camshaft phaser for 1) selectively receiving the pressurized oil from one of the advance chambers and directing the pressurized oil to the lock pin for disengaging the lock pin from the lock pin seat, 2) selectively receiving the pressurized oil from one of the retard chambers and directing the pressurized oil to the lock pin for disengaging the lock pin from the lock pin, and 3) venting the pressurized oil from the lock pin for engaging the lock pin with the lock pin seat. Since the lock pin oil control valve is supplied with pressurized oil by the advance chambers and the retard chambers, a separate dedicated oil supply is not needed for the lock pin oil control valve.

Further features and advantages of the invention will appear more clearly on a reading of the following detailed description of the preferred embodiment of the invention, which is given by way of non-limiting example only and with reference to the accompanying drawings.

BRIEF DESCRIPTION OF DRAWINGS

This invention will be further described with reference to the accompanying drawings in which.

DETAILED DESCRIPTION OF INVENTION

Figure 1:
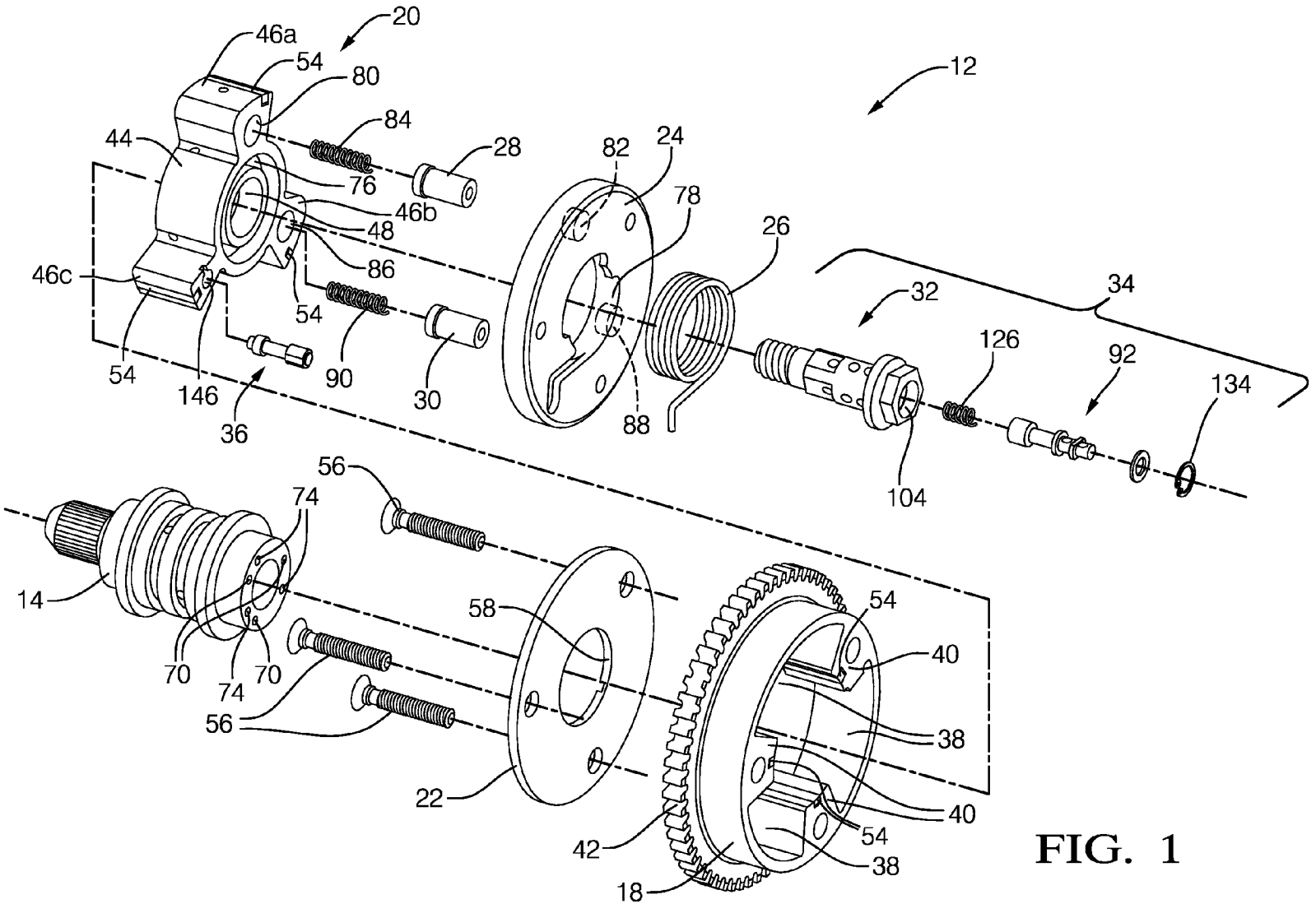
FIG. 1 is an exploded isometric view of a camshaft phaser in accordance with the present invention.
Figure 2:
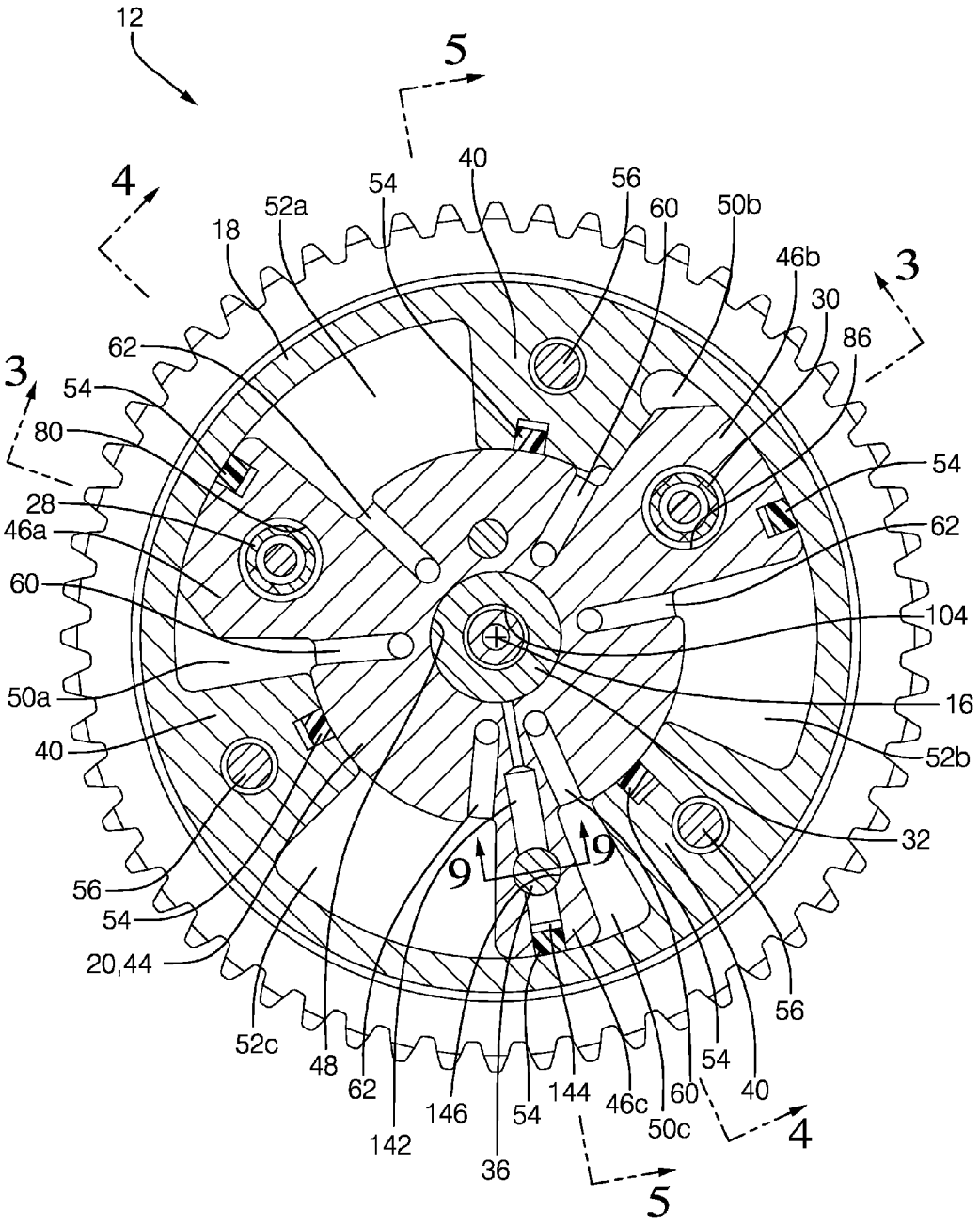
FIG. 2 is a radial cross-sectional view of the camshaft phaser in accordance with the present invention.
Figure 3:
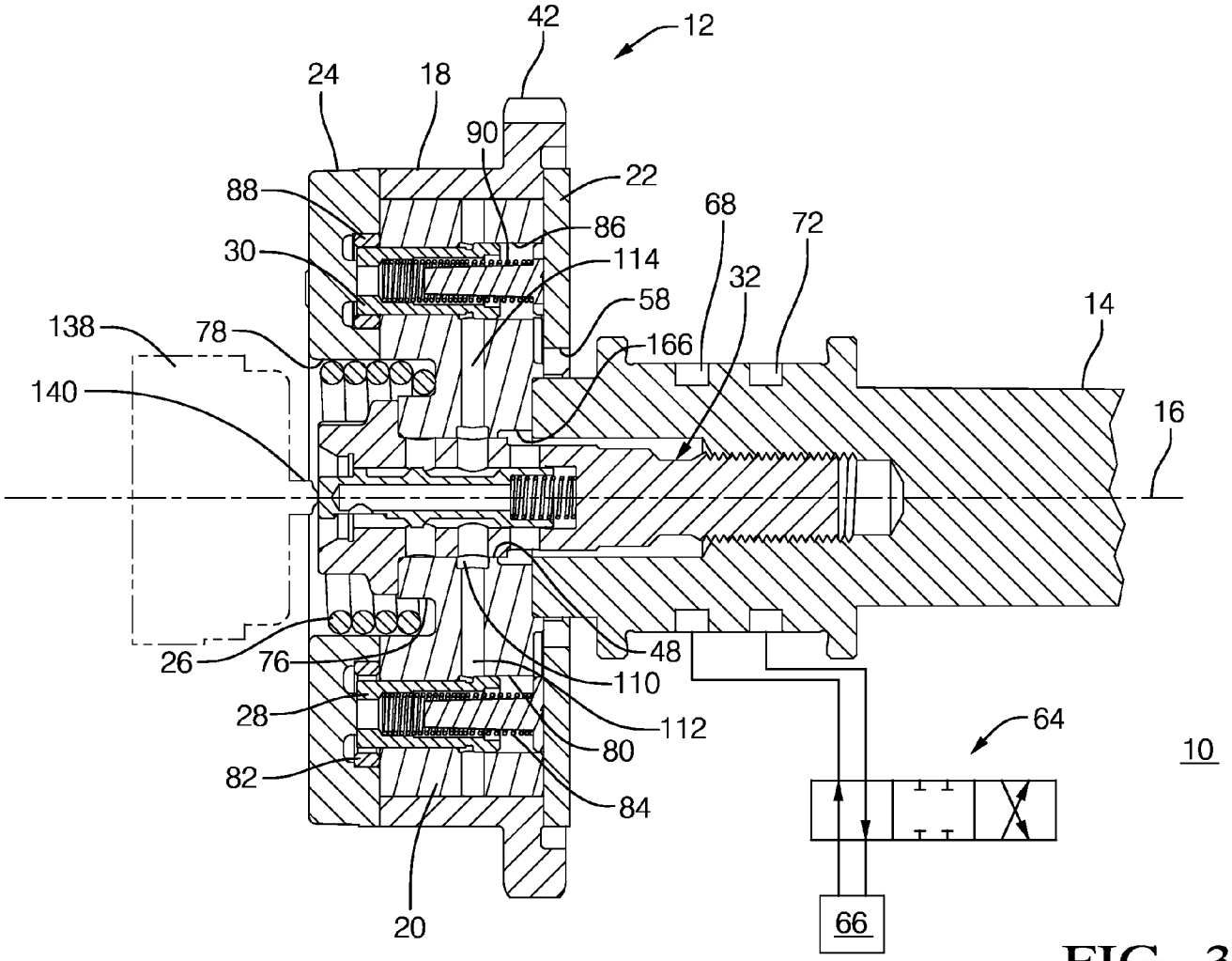
FIG. 3. is an axial cross-sectional view of the camshaft phaser in accordance with the present invention taken through section line 3-3 of FIG. 2.
Figure 4:
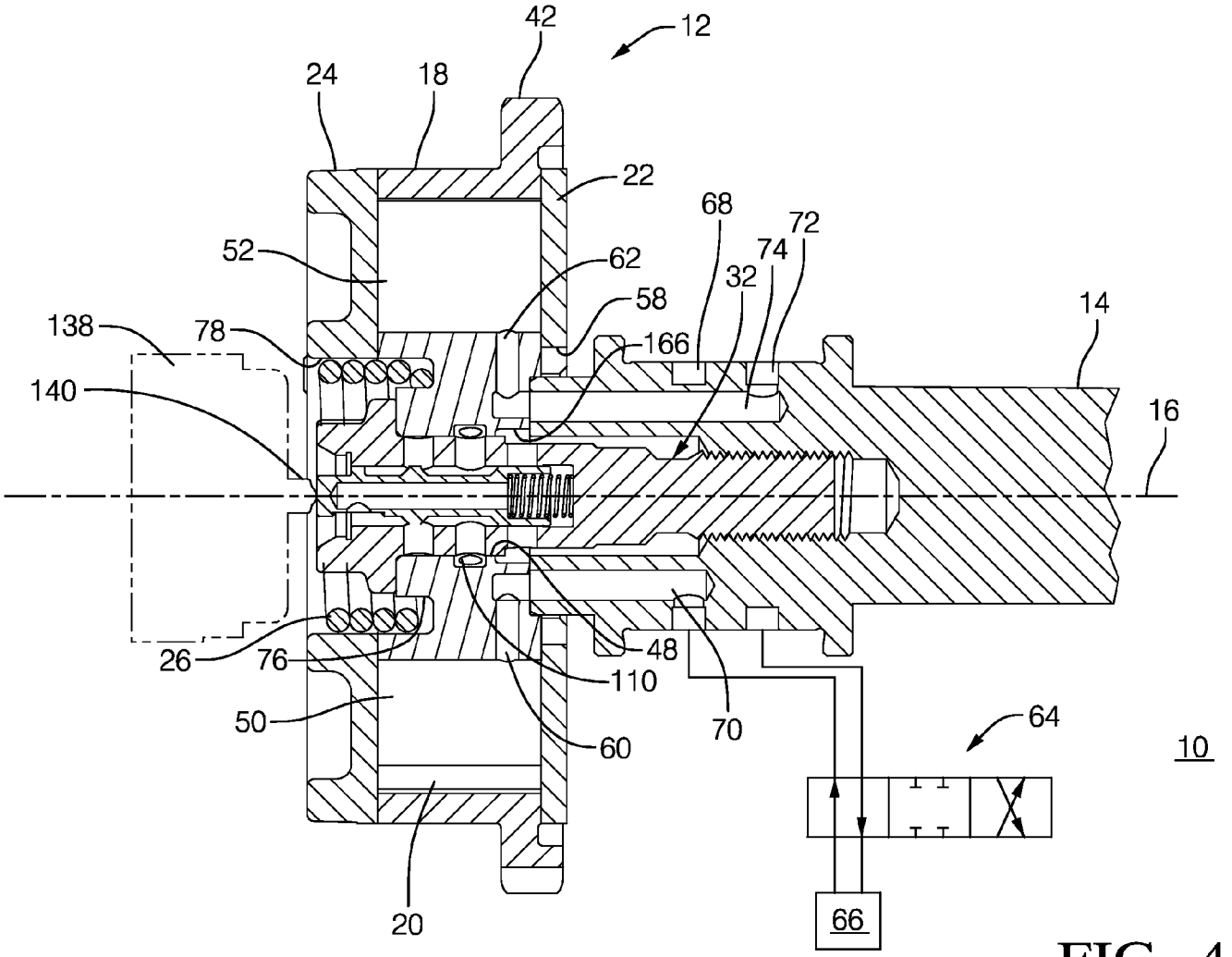
FIG. 4. is an axial cross-sectional view of the camshaft phaser in accordance with the present invention taken through section line 4-4 of FIG. 2.

In accordance with a preferred embodiment of this invention and referring to FIGS. 1, 2, 3, and 4, an internal combustion engine 10 is shown which includes a camshaft phaser 12. Internal combustion engine 10 also includes a camshaft 14 which is rotatable about a camshaft axis 16 based on rotational input from a crankshaft and chain (not shown) driven by a plurality of reciprocating pistons (also not shown). As camshaft 14 is rotated, it imparts valve lifting and closing motion to intake and/or exhaust valves (not shown) as is well known in the internal combustion engine art. Camshaft phaser 12 allows the timing between the crankshaft and camshaft 14 to be varied. In this way, opening and closing of the intake and/or exhaust valves can be advanced or retarded in order to achieve desired engine performance.

Camshaft phaser 12 generally includes a stator 18, a rotor 20 disposed coaxially within stator 18, a back cover 22 closing off one end of stator 18, a front cover 24 closing off the other end of stator 18, a bias spring 26 for urging rotor 20 in one direction relative to stator 18, a primary lock pin 28, a secondary lock pin 30, a camshaft phaser attachment bolt 32 for attaching camshaft phaser 12 to camshaft 14, a lock pin oil control valve 34 for controlling pressurized oil supplied to and vented from primary lock pin 28 and secondary lock pin 30, and a shuttle valve 36 for directing pressurized oil to lock pin oil control valve 34. The various elements of camshaft phaser 12 will be described in greater detail in the paragraphs that follow.

Stator 18 is generally cylindrical and includes a plurality of radial chambers 38 defined by a plurality of lobes 40 extending radially inward. In the embodiment shown, there are three lobes 40 defining three radial chambers 38, however, it is to be understood that a different number of lobes 40 may be provided to define radial chambers 38 equal in quantity to the number of lobes 40. Stator 18 may also include a sprocket 42 formed integrally therewith or otherwise fixed thereto. Sprocket 42 is configured to be driven by a chain or gear that is driven by the crankshaft of internal combustion engine 10. Alternatively, sprocket 42 may be a pulley driven by a belt.

Rotor 20 includes a central hub 44 with a plurality of vanes 46*a*, 46*b*, 46*c* extending radially outward therefrom and a central through bore 48 extending axially therethrough. From this point forward, each vane 46*a*, 46*b*, 46*c* will be referred to generically as vane 46 unless reference is being made to a specific vane 46. The number of vanes 46 is equal to the number of radial chambers 38 provided in stator 18. Rotor 20 is coaxially disposed within stator 18 such that each vane 46 divides each radial chamber 38 into advance chambers 50*a*, 50*b*, 50*c* and retard chambers 52*a*, 52*b*, 52*c*. From this point forward, each advance chamber 50*a*, 50*b*, 50*c* will be referred to generically as advance chamber 50 unless reference is being made to a specific advance chamber 50. Similarly, each retard chamber 52*a*, 52*b*, 52*c* will be referred to generically as retard chamber 52 unless reference is being made to a specific retard chamber 52. The radial tips of lobes 40 are mateable with central hub 44 in order to separate radial chambers 38 from each other. Each of the radial tips of lobes 40 and the tips of vanes 46 may include one of a plurality of wiper seals 54 to substantially seal adjacent advance chambers 50 and retard chambers 52 from each other.

Back cover 22 is sealingly secured, using cover bolts 56, to the axial end of stator 18 that is proximal to camshaft 14. Tightening of cover bolts 56 prevents relative rotation between back cover 22 and stator 18. Back cover 22 includes a back cover central bore 58 extending coaxially therethrough. The end of camshaft 14 is received coaxially within back cover central bore 58 such that camshaft 14 is allowed to rotate relative to back cover 22. In an alternative arrangement, sprocket 42 may be integrally formed or otherwise attached to back cover 22 rather than to stator 18 as described previously.

Similarly, front cover 24 is sealingly secured, using cover bolts 56, to the axial end of stator 18 that is opposite back cover 22. Cover bolts 56 pass through stator 18 and threadably engage front cover 24, thereby clamping stator 18 between back cover 22 and front cover 24 to prevent relative rotation between stator 18, back cover 22, and front cover 24. In this way, advance chambers 50 and retard chambers 52 are defined axially between back cover 22 and front cover 24.

Camshaft phaser 12 is attached to camshaft 14 with camshaft phaser attachment bolt 32 which extends coaxially through central through bore 48 of rotor 20 and threadably engages camshaft 14, thereby by clamping rotor 20 securely to camshaft 14. In this way, relative rotation between stator 18 and rotor 20 results in a change in phase relationship or timing between the crankshaft of internal combustion engine 10 and camshaft 14. Camshaft phaser attachment bolt 32 will be discussed in greater detail later.

Pressurized oil is selectively supplied to advance chambers 50 and vented from retard chambers 52 in order to cause relative rotation between stator 18 and rotor 20 which results in advancing the timing of camshaft 14 relative to the crankshaft of internal combustion engine 10. Conversely, oil is selectively supplied to retard chambers 52 and vented from advance chambers 50 in order to cause relative rotation between stator 18 and rotor 20 which results in retarding the timing of camshaft 14 relative to the crankshaft of internal combustion engine 10. Advance oil passages 60 may be provided in rotor 20 for supplying and venting oil to and from advance chambers 50 while retard oil passages 62 may be provided in rotor 20 for supplying and venting oil to and from retard chambers 52. Supplying and venting of oil to and from advance chambers 50 and retard chambers 52 may be controlled by a phasing oil control valve 64 located external to camshaft phaser 12, for example, within internal combustion engine 10. Phasing oil control valve 64 is shown in schematic form in FIG. 3 and receives pressurized oil from an oil source 66, for example an oil pump used to lubricate various components of internal combustion engine 10. When it is desired to advance the timing of camshaft 14 relative to the crankshaft, phasing oil control valve 64 is operated to supply pressurized oil to advance chambers 50 while venting oil from retard chambers 52. Pressurized oil from phasing oil control valve 64 is supplied to advance chambers 50 through annular camshaft advance oil passage 68 of camshaft 14, axial camshaft advance oil passages 70 of camshaft 14, and advance oil passages 60 of rotor 20. At the same time, oil is vented from retard chambers 52 through annular camshaft retard oil passage 72 of camshaft 14, axial camshaft retard oil passages 74 of camshaft 14, and retard oil passages 62 of rotor 20. Conversely, when it is desired to retard the timing of camshaft 14 relative to the crankshaft, phasing oil control valve 64 is operated to supply pressurized oil to retard chambers 52 while venting oil from advance chambers 50. Pressurized oil from phasing oil control valve 64 is supplied to retard chambers 52 through annular camshaft retard oil passage 72 of camshaft 14, axial camshaft retard oil passages 74 of camshaft 14, and retard oil passages 62 of rotor 20. At the same time, oil is vented from advance chambers 50 through annular camshaft advance oil passage 68 of camshaft 14, axial camshaft advance oil passages 70 of camshaft 14, and advance oil passages 60 of rotor 20. When no change in timing is desired between camshaft 14 the crankshaft, phasing oil control valve 64 is operated to substantially equalize the pressure between advance chambers 50 and retard chambers 52. This may be accomplished by providing minimal fluid communication from phasing oil control valve 64 to advance chambers 50 and retard chambers 52 simultaneously. In this way, rotor 20 rotates within stator 18 between a maximum advance position and a maximum retard position as determined by the space available for vanes 46 to move within radial chambers 38.

Bias spring 26 is disposed within an annular pocket 76 formed in rotor 20 and within a central bore 78 of front cover 24. Bias spring 26 is grounded at one end thereof to front cover 24 and is attached at the other end thereof to rotor 20. In this way, bias spring 26 either partially or completely offsets the natural retarding torque induced by the overall valve train friction, to balance performance times, or to help return the phaser to a predetermined aligned position of rotor 20 within stator 18 which is between the full advance and full retard positions. When internal combustion engine 10 is shut down or if there is a malfunction of phasing oil control valve 64, bias spring 26 urges rotor 20 to a predetermined aligned position within stator 18 as established by primary lock pin 28 and secondary lock pin 30 as will be described in detail below.

Primary lock pin 28 and secondary lock pin 30 define a staged dual lock pin system for selectively preventing relative rotation between stator 18 and rotor 20 at the predetermined aligned position which is between the full retard and the full advance positions. Primary lock pin 28 is slidably disposed within a primary lock pin bore 80 formed in vane 46*a* of rotor 20. A primary lock pin seat 82 is formed in front cover 24 for selectively receiving primary lock pin 28 therewithin. Primary lock pin seat 82 is larger than primary lock pin 28 to allow rotor 20 to rotate relative to stator 18 about 5° on each side of the predetermined aligned position when primary lock pin 28 is seated within primary lock pin seat 82. The enlarged nature of primary lock pin seat 82 allows primary lock pin 28 to be easily received therewithin. When primary lock pin 28 is not desired to be seated within primary lock pin seat 82, pressurized oil is supplied to primary lock pin 28, thereby urging primary lock pin 28 out of primary lock pin seat 82 and compressing a primary lock pin spring 84. Conversely, when primary lock pin 28 is desired to be seated within primary lock pin seat 82, the pressurized oil is vented from primary lock pin 28, thereby allowing primary lock pin spring 84 to urge primary lock pin 28 toward front cover 24. In this way, primary lock pin 28 is seated within primary lock pin seat 82 by primary lock pin spring 84 when rotor 20 is positioned within stator 18 to allow alignment of primary lock pin 28 with primary lock pin seat 82. Supplying and venting of pressurized oil to and from primary lock pin 28 will be described in greater detail later.

Secondary lock pin 30 is slidably disposed within a secondary lock pin bore 86 formed in vane 46*b* of rotor 20. A secondary lock pin seat 88 is formed in front cover 24 for selectively receiving secondary lock pin 30 therewithin. Secondary lock pin 30 fits within secondary lock pin seat 88 in a close sliding relationship, thereby substantially preventing relative rotation between rotor 20 and stator 18 when secondary lock pin 30 is received within secondary lock pin seat 88. When secondary lock pin 30 is not desired to be seated within secondary lock pin seat 88, pressurized oil is supplied to secondary lock pin 30, thereby urging secondary lock pin 30 out of secondary lock pin seat 88 and compressing a secondary lock pin spring 90. Conversely, when secondary lock pin 30 is desired to be seated within secondary lock pin seat 88, the pressurized oil is vented from secondary lock pin 30, thereby allowing secondary lock pin spring 90 to urge secondary lock pin 30 toward front cover 24. In this way, secondary lock pin 30 is seated within secondary lock pin seat 88 by secondary lock pin spring 90 when rotor 20 is positioned within stator 18 to allow alignment of secondary lock pin 30 with secondary lock pin seat 88. Supplying and venting of pressurized oil to and from secondary lock pin 30 will be described in greater detail later.

Further features and details of the operation of primary lock pin 28 and secondary lock pin 30 are describe in U.S. Pat. No. 7,421,989 to Fischer et al. and U.S. Pat. No. 8,056,519 to Cuatt et al., the disclosures of which are each incorporated herein by reference in their entirety.

Figure 5:
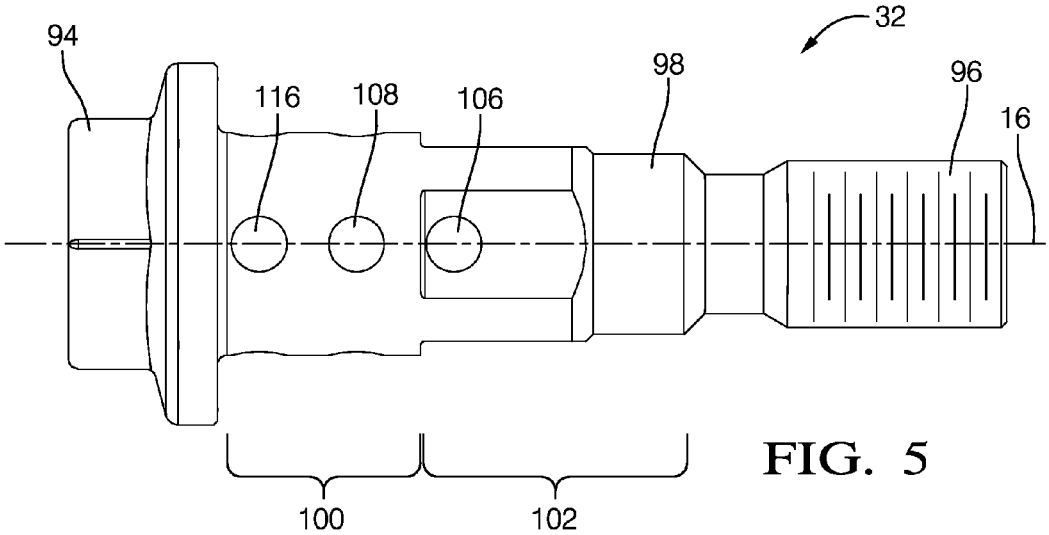
FIG. 5 is an elevation view of a camshaft phaser attachment bolt of the camshaft phaser in accordance with the present invention.
Figure 6A:
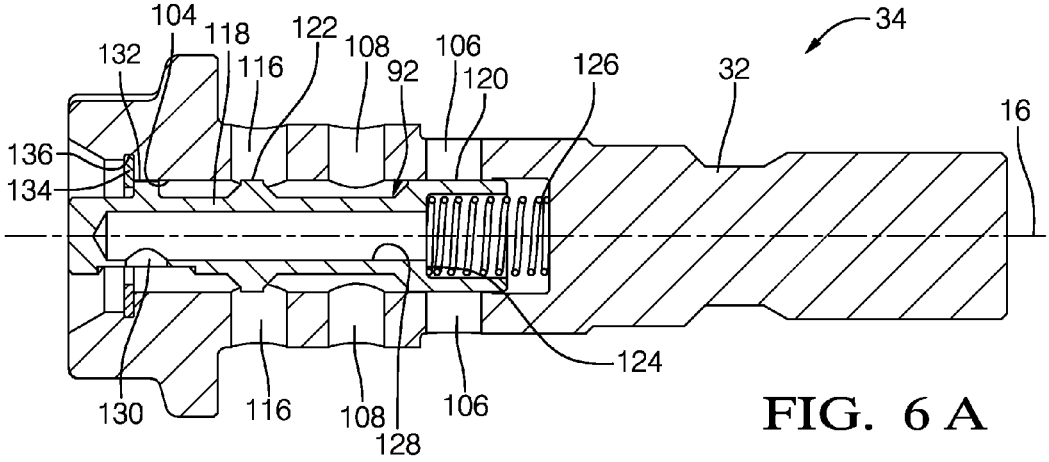
FIG. 6A is an axial cross-sectional view of the camshaft phaser attachment bolt of FIG. 5 showing a lock pin oil control valve in a lock pin engaging position.
Figure 6B:
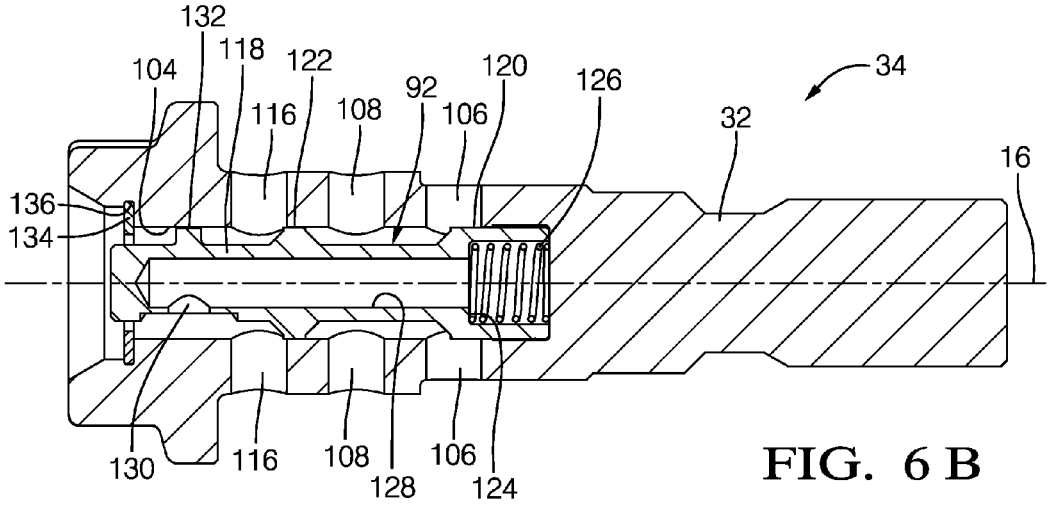
FIG. 6B is the axial cross-sectional view of FIG. 6A now showing the lock pin oil control valve in a lock pin disengaging position.

With continued reference to FIGS. 1-4 and now with addition reference to FIGS. 5, 6A, and 6B, lock pin oil control valve 34 comprises camshaft phaser attachment bolt 32 and a lock pin control valve spool 92. Camshaft phaser attachment bolt 32 includes a bolt head 94 at the end of camshaft phaser attachment bolt 32 that is distal from camshaft 14, a bolt threaded end 96 that is proximal to camshaft 14, and a bolt shank 98 connecting bolt head 94 to bolt threaded end 96. A shank sealing portion 100 of bolt shank 98 that is cylindrical and proximal to bolt head 94 extends coaxially through central hub 44 of rotor 20 in a close fitting relationship. A shank supply portion 102 of bolt shank 98 extends away from shank sealing portion 100 and connects shank sealing portion 100 to bolt threaded end 96.

A valve bore 104 extends coaxially into camshaft phaser attachment bolt 32 beginning at the end of camshaft phaser attachment bolt 32 that is defined by bolt head 94. Camshaft phaser attachment bolt 32 includes lock pin valve spool supply passages 106 which extend radially through camshaft phaser attachment bolt 32 from valve bore 104 to the outside surface of shank supply portion 102, thereby providing fluid communication between the outside surface of shank supply portion 102 and valve bore 104. Camshaft phaser attachment bolt 32 also includes lock pin valve working passages 108 which extend radially through camshaft phaser attachment bolt 32 from valve bore 104 to the outside surface of shank sealing portion 100, thereby providing fluid communication between the outside surface of shank sealing portion 100 and valve bore 104. Lock pin valve working passages 108 are aligned with an annular lock pin groove 110 formed on the inside surface of central through bore 48 of rotor 20. Lock pin groove 110 is in fluid communication with a primary lock pin oil passage 112 and a secondary lock pin oil passage 114 which are in fluid communication with primary lock pin 28 and secondary lock pin 30 respectively. Camshaft phaser attachment bolt 32 also includes lock pin valve vent passages 116 which extend radially through camshaft phaser attachment bolt 32 from valve bore 104 to the outside surface of shank sealing portion 100, however, as will be understood more clearly later, the function of lock pin valve vent passages 116 does not required fluid communication be provided between valve bore 104 and the outside surface of shank sealing portion 100. Accordingly, lock pin valve vent passages 116 may be substituted with an annular groove (not shown) extending radially outward from valve bore 104.

Lock pin control valve spool 92 is slidably disposed within valve bore 104 of camshaft phaser attachment bolt 32 for selectively allowing pressurized oil from lock pin valve spool supply passages 106 to be communicated to primary lock pin 28 and secondary lock pin 30 when lock pin control valve spool 92 is slid to an unlocking position as shown in FIG. 6B. Lock pin control valve spool 92 also selectively prevents pressurized oil from being communicated from lock pin valve spool supply passages 106 to primary lock pin 28 and secondary lock pin 30 and vents oil from primary lock pin 28 and secondary lock pin 30 when lock pin control valve spool 92 is slid to a locking position as shown in FIG. 6A.

Lock pin control valve spool 92 includes a valve spool body 118 which is sized to provide radial clearance with valve bore 104. An annular supply land 120 extends radially outward from valve spool body 118 at the end of valve spool body 118 proximal to lock pin valve spool supply passages 106. Supply land 120 is sized to ride closely within valve bore 104 and substantially prevents fluid communication between lock pin valve spool supply passages 106 and lock pin valve working passages 108 when lock pin control valve spool 92 is in the locking position.

Lock pin control valve spool 92 also includes an annular vent land 122 which extends radially outward from valve spool body 118 and is positioned axially away from supply land 120 toward bolt head 94. Vent land 122 is sized to ride closely within valve bore 104 and substantially prevents fluid communication between lock pin valve working passages 108 and lock pin valve vent passages 116 when lock pin control valve spool 92 is in the unlocking position. Conversely, when lock pin control valve spool 92 is in the locking position, vent land 122 is aligned with lock pin valve vent passages 116 and oil is vented from primary lock pin 28 and secondary lock pin 30 through lock pin valve working passages 108, to valve bore 104, to lock pin valve vent passages 116, to valve bore 104, and then out the end of camshaft phaser attachment bolt 32.

Lock pin control valve spool 92 also includes a spool spring seat 124 defined by a bore extending axially into the end of lock pin control valve spool 92 that is proximal to the bottom of valve bore 104. Spool spring seat 124 receives one end of a spool spring 126 while the other end of spool spring 126 is grounded to the bottom of valve bore 104. Spool spring 126 applies a biasing force on lock pin control valve spool 92 away from the bottom of valve bore 104.

Lock pin control valve spool 92 also includes a spool vent bore 128 extending coaxially into lock pin control valve spool 92 from spool spring seat 124 and axially past vent land 122. A spool vent connecting passage 130 extends radially through lock pin control valve spool 92 to provide fluid communication between spool vent bore 128 and valve bore 104. In this way, any oil that may leak past supply land 120 to the bottom of valve bore 104 is vented through spool vent bore 128 and spool vent connecting passage 130.

Lock pin control valve spool 92 also includes a retention wing 132 extending radially outward from valve spool body 118, however, retention wing 132 does not extend around the entire perimeter of valve spool body 118 and may be sized to not ride closely within valve bore 104. When lock pin control valve spool 92 is in the locking position, retention wing 132 abuts a retention clip 134 which is fixed within a retention clip groove 136 formed in valve bore 104 of camshaft phaser attachment bolt 32, thereby limiting the travel of lock pin control valve spool 92 and retaining lock pin control valve spool 92 within valve bore 104.

An actuator 138 is provided to displace lock pin control valve spool 92 from the locking position to the unlocking position. Actuator 138 may be, for example, a solenoid actuator with an actuator shaft 140. When an electric current is applied to actuator 138, actuator shaft 140 moves lock pin control valve spool 92 toward the bottom of valve bore 104 to the unlocking position, thereby compressing spool spring 126. When the application of the electric current to actuator 138 is stopped, spool spring 126 urges lock pin control valve spool 92 back to the locking position. Solenoid actuators are well known and will not be described further herein. While actuator 138 has been described as a solenoid actuator, it should be understood that any type of actuator may be used which would provide the necessary axial movement to lock pin control valve spool 92.

Further features and details of operation of lock pin oil control valve 34 are described in U.S. patent application Ser. No. 13/667,127 to Lichti et al., the disclosure of which is incorporated herein by reference in its entirety.

In order for lock pin control valve spool 92 to direct pressurized oil to primary lock pin 28 and secondary lock pin 30 when lock pin control valve spool 92 is placed in the unlocking position by actuator 138, pressurized oil must be supplied to lock pin valve spool supply oil passages 106. Pressurized oil is selectively supplied to lock pin valve spool supply oil passages 106 by advance chamber 50*c* and by retard chamber 52*c* as will be described in the paragraphs that follow.

Figure 9:
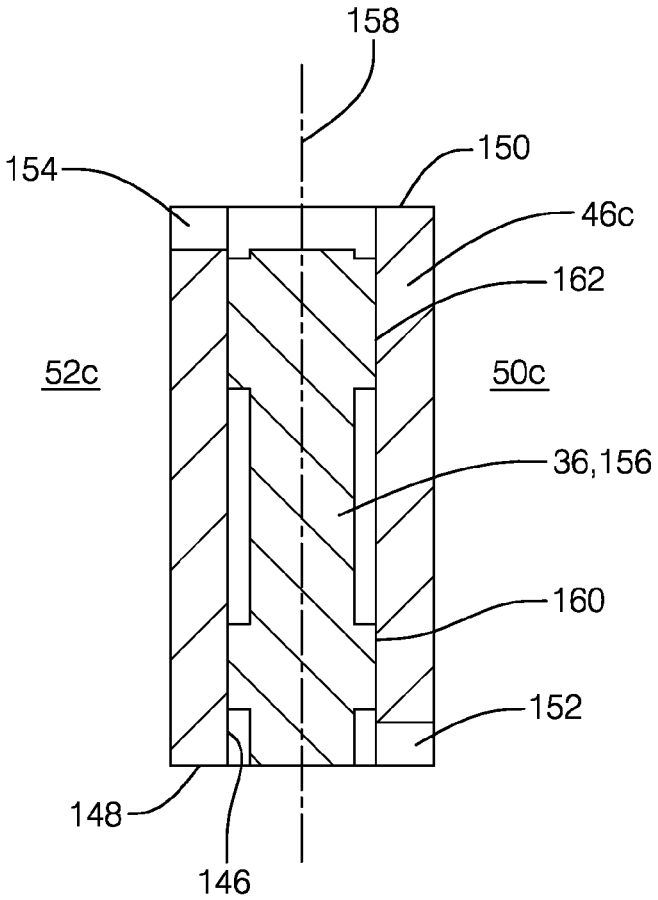
FIG. 9 is a cross-sectional view of a rotor vane and the shuttle valve taken through section line 7-7 of FIG. 2.
Figure 10:
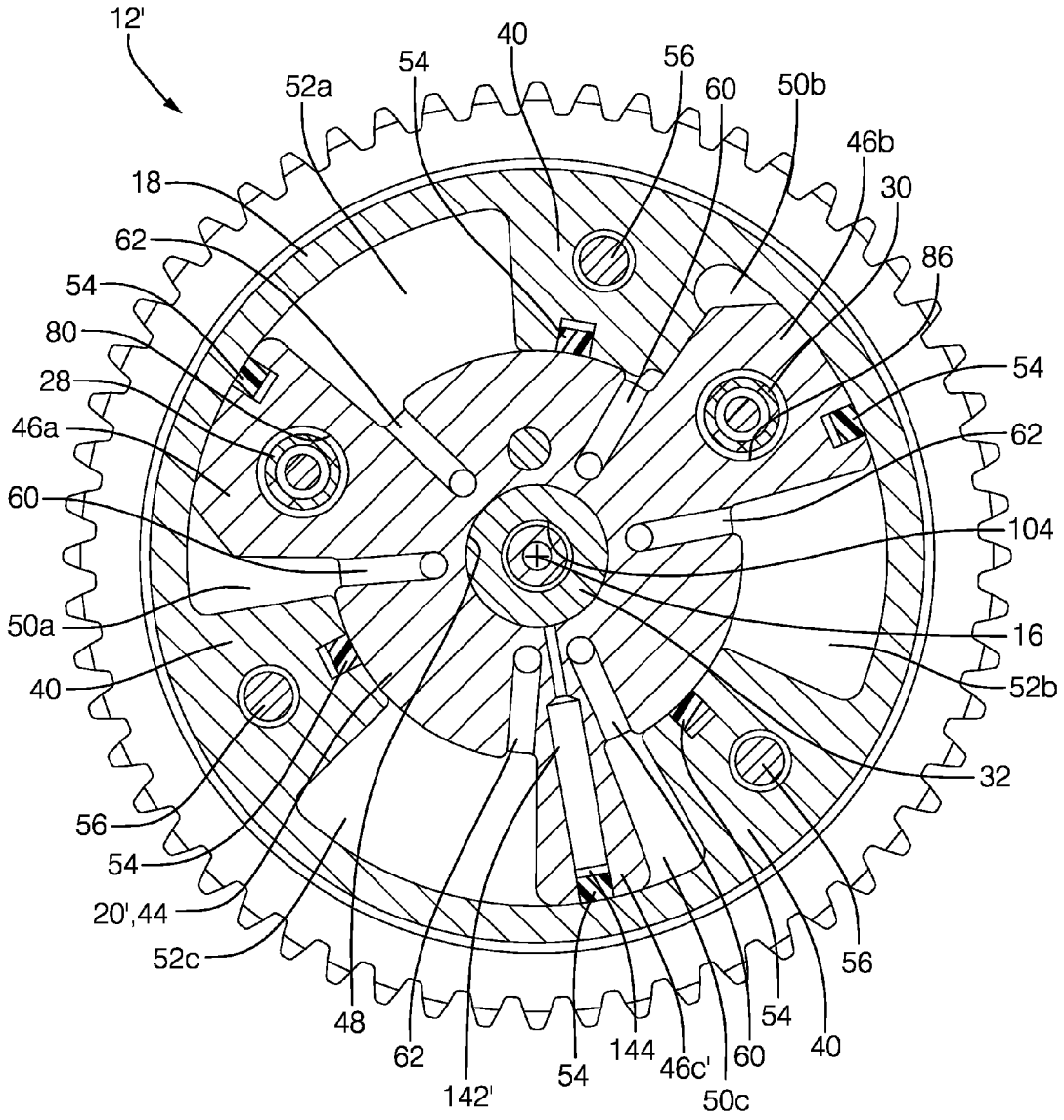
FIG. 10 is a radial cross-sectional view of an alternative camshaft phaser in accordance with the present invention.

With continued reference to FIGS. 1-4 and now with additional reference to FIGS. 7A, 7B, 7C, 8, and 9, a lock pin valve supply passage 142 is provided in vane 46*c* of rotor 20 in order to supply pressurized oil to lock pin valve spool supply oil passages 106 from advance chamber 50*c* and from retard chamber 52*c*. Lock pin valve supply passage 142 extends substantially radially outward from central through bore 48 of rotor 20 and may extend to a wiper seal groove 144 within which wiper seal 54 of vane 46*c* is disposed. A shuttle valve bore 146 is provided in vane 46*c* for slidably receiving shuttle valve 36 therein and is in fluid communication with lock pin valve supply passage 142. Shuttle valve bore 146 extends axially through vane 46*c*, in the same general direction as camshaft axis 16, from a first axial face 148 of rotor 20 which is adjacent to back cover 22 to a second axial face 150 of rotor 20 which is adjacent to front cover 24. As best shown in FIG. 9, a first shuttle valve supply passage 152 is provided in vane 46*c* to provide fluid communication between advance chamber 50*c* and shuttle valve bore 146 while a second shuttle valve supply passage 154 is provided in vane 46*c* to provide fluid communication between retard chamber 52*c* and shuttle valve bore 146.

Shuttle valve 36 includes a shuttle valve body 156 which extends along a shuttle valve axis 158 and which is sized to provide radial clearance with shuttle valve bore 146. A shuttle valve oil controlling land 160 extends radially outward from shuttle valve body 156 and is sized to ride closely within shuttle valve bore 146 to substantially prevent oil from passing between shuttle valve oil controlling land 160 and shuttle valve bore 146. Shuttle valve oil controlling land 160 is located between first shuttle valve supply passage 152 and second shuttle valve supply passage 154 and acts as a piston to alter the position of shuttle valve 36 along valve axis 158 within shuttle valve bore 146 as will be described in greater detail later. Shuttle valve 36 also includes a shuttle valve guiding land 162 which extends radially outward from shuttle valve body 156 and is sized to ride closely within shuttle valve bore 146 to substantially prevent tipping of shuttle valve 36 within shuttle valve bore 146 while substantially not inhibiting axial movement of shuttle valve 36 within shuttle valve bore 146. Shuttle valve guiding land 162 includes one or more oil flow features, illustrated as flats 164, to allow oil to pass by shuttle valve guiding land 162 within shuttle valve bore 146. While the flow features of shuttle valve guiding land 162 have been illustrated as flats 164, it should now be understood that other geometries may be used, for example only, grooves, flutes, and bores.

The operation of shuttle valve 36 will now be described. When phasing oil control valve 64 is operated to supply pressurized oil to advance chambers 50, pressurized oil is supplied to shuttle valve bore 146 and reacts against shuttle valve oil controlling land 160 to urge shuttle valve 36 toward front cover 24 as is shown in FIG. 7B. When this happens, shuttle valve oil controlling land 160 substantially blocks fluid communication between retard chamber 52*c* and lock pin valve supply passage 142 while permitting pressurized oil to be communicated to lock pin valve supply passage 142 from advance chamber 50*c* via first shuttle valve supply passage 152. From lock pin valve supply passage 142 the pressurized oil passes to central through bore 48 of rotor 20 where an undercut 166 in central through bore 48 allows the pressurized oil to pass to lock pin valve spool supply passages 106. It should be noted that shuttle valve oil controlling land 160 also substantially prevents pressurized oil from being communicated from advance chamber 50*c* to retard chamber 52*c*. Actuator 138 is then operated to position lock pin control valve spool 92 to either allow or prevent the pressurized oil from being communicated to primary lock pin 28 and secondary lock pin 30 as described above.

Figure 7A:
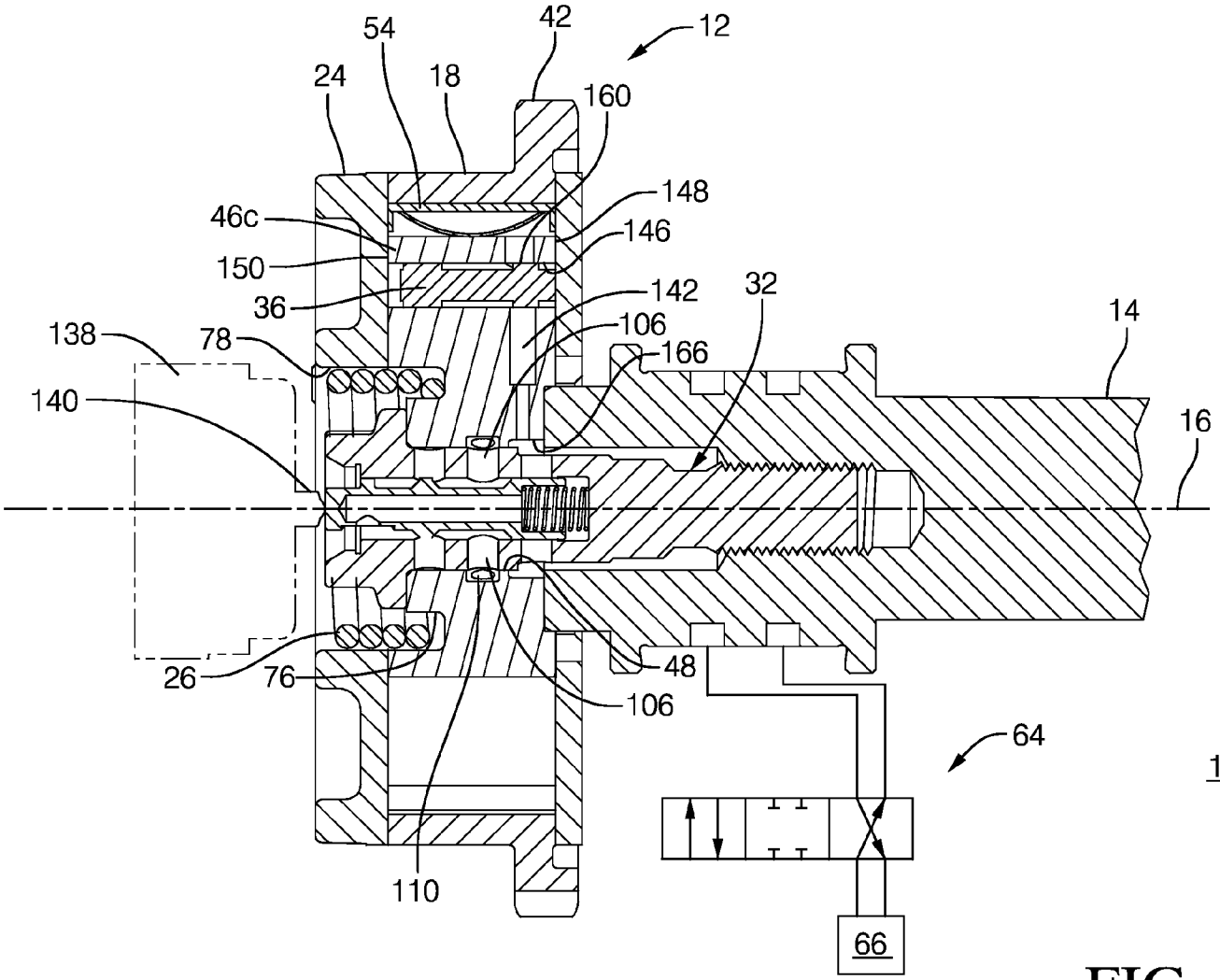
FIG. 7A is an axial cross-sectional view of the camshaft phaser in accordance with the present invention taken through section line 7-7 of FIG. 2 and showing a shuttle valve positioned to direct pressurized oil from an advance chamber to the lock pin oil control valve.
Figure 7B:
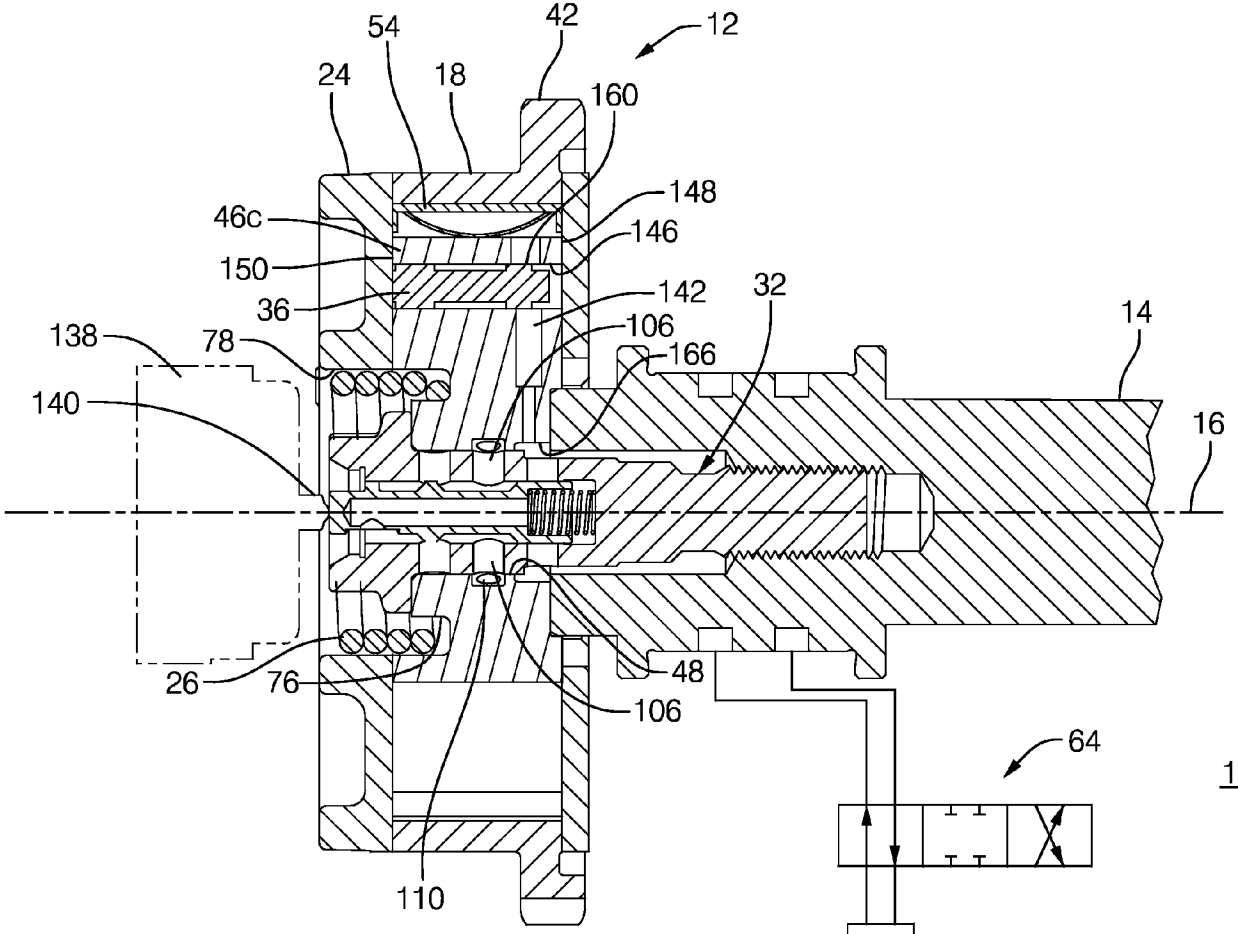
FIG. 7B is the axial cross-sectional view of FIG. 7A now showing the shuttle valve positioned to direct pressurized oil from a retard chamber to the lock pin oil control valve.

Conversely, when phasing oil control valve 64 is operated to supply pressurized oil to retard chambers 52, pressurized oil is supplied to shuttle valve bore 146 and reacts against shuttle valve oil controlling land 160 to urge shuttle valve 36 toward back cover 22 as shown in FIG. 7A. When this happens, shuttle valve oil controlling land 160 substantially blocks fluid communication between advance chamber 50*c* and lock pin valve supply passage 142 while permitting pressurized oil to be communicated to lock pin valve supply passage 142 from retard chamber 52*c* via second shuttle valve supply passage 154. From lock pin valve supply passage 142, the pressurized oil passes to central through bore 48 of rotor 20 where undercut 166 in central through bore 48 allows the pressurized oil to pass to lock pin valve spool supply passages 106. It should be noted that shuttle valve oil controlling land 160 also substantially prevents pressurized oil from being communicated from retard chamber 52*c* to advance chamber 50*c*. Actuator 138 is then operated to position lock pin control valve spool 92 to either allow or prevent the pressurized oil from being communicated to primary lock pin 28 and secondary lock pin 30 as described above.

Figure 7C:
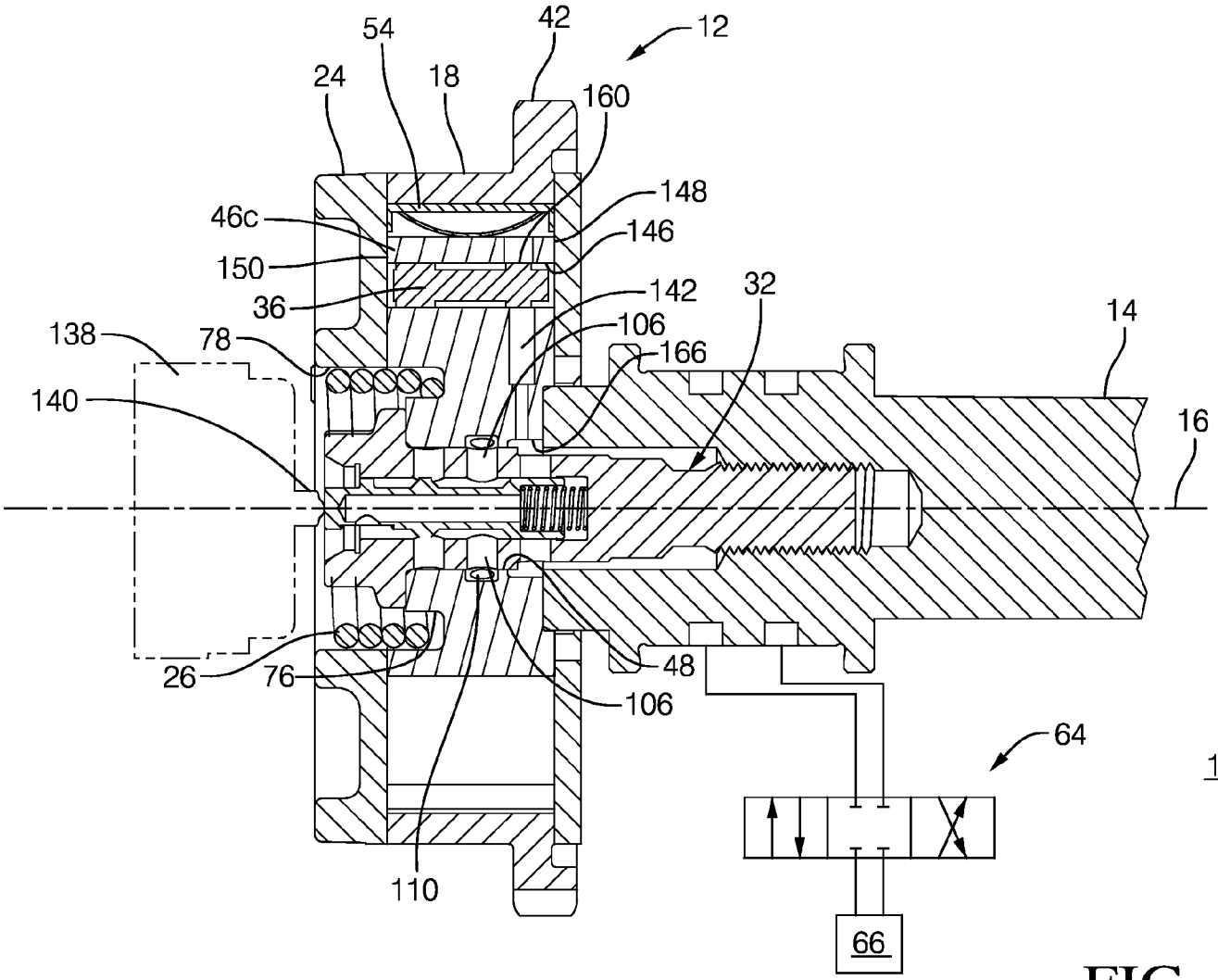
FIG. 7C is the axial cross-sectional view of FIGS. 7A and 7B now showing the shuttle valve positioned to simultaneously direct pressurized oil from the advance chamber and the retard chamber to the lock pin oil control valve.
Figure 8:
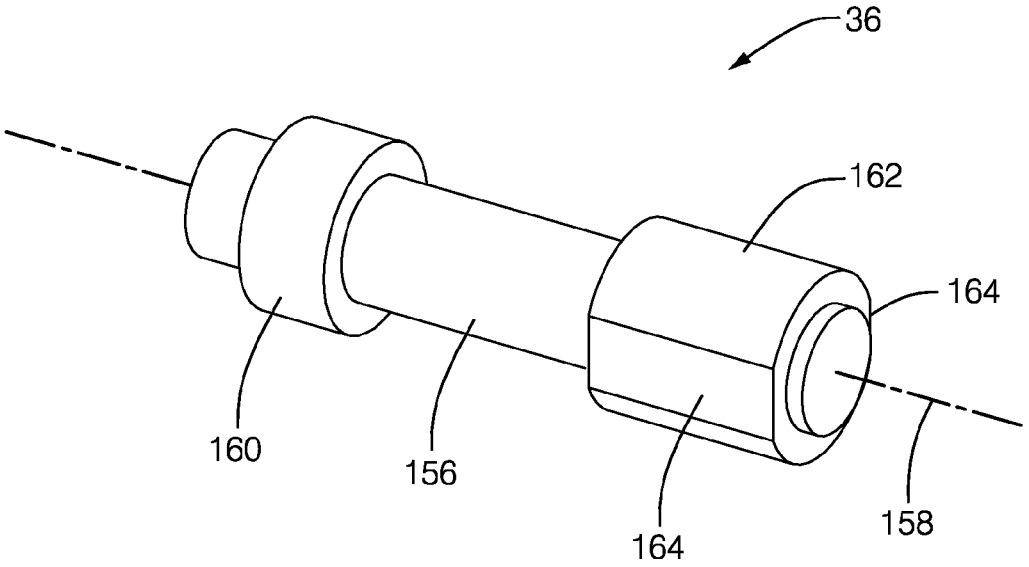
FIG. 8 is an enlarged isometric view of the shuttle valve of the camshaft phaser in accordance with the present invention.

Pressurized oil may also be supplied to lock pin valve spool supply passages 106 through lock pin valve supply passage 142 from both advance chamber 50*c* and retard chamber 52*c* simultaneously as shown in FIG. 7C. This may occur when phasing oil control valve 64 is operated to supply pressurized oil to both advance chambers 50 and retard chambers 52 as described above relative to the operation of phasing oil control valve 64. When pressurized oil is supplied to both advance chambers 50 and retard chambers 52, shuttle valve 36 is positioned by pressurized oil from advance chamber 50*c* and retard chamber 52*c* such that shuttle valve oil controlling land 160 is substantially centered at lock pin valve supply passage 142. Shuttle valve oil controlling land 160 is narrower than the diameter of lock pin valve supply passage 142, consequently, fluid communication is simultaneously provided between advance chamber 50*c* and lock pin valve supply passage 142 and between retard chamber 52*c* and lock pin valve supply passage 142. From lock pin valve supply passage 142 the pressurized oil passes to central through bore 48 of rotor 20 where undercut 166 in central through bore 48 allows the pressurized oil to pass to lock pin valve spool supply passages 106. Actuator 138 is then operated to position lock pin control valve spool 92 to either allow or prevent the pressurized oil from being communicated to primary lock pin 28 and secondary lock pin 30 as described earlier.

Reference will now be made to FIGS. 10, 11A, 11B, and 11C which show an alternative camshaft phaser 12' which is substantially the same as camshaft phaser 12 except as will now be described. Camshaft phaser 12' differs from camshaft phaser 12 in that camshaft phaser 12' does not include shuttle valve 36 and consequently also does not include shuttle valve bore 146. Camshaft phaser 12' instead uses wiper seal 54 in vane 46*c*' of rotor 20' to selectively supply pressurized oil from advance chamber 50*c* and/or retard chamber 52*c* to lock pin oil control valve 34 as will be describe in the paragraphs that follow.

Wiper seal 54 is received within wiper seal groove 144 which is defined by a first groove side 168, a second groove side 170 opposing and facing toward first groove side 168, and a groove bottom 172 joining first groove side 168 and second groove side 170. It should be noted that clearances between wiper seal 54 and wiper seal groove 144 and clearances between vane 46*c*' and stator 18 may be exaggerated in the drawings in order to more clearly show the path that the pressurized oil takes. Lock pin valve supply passage 142' is in fluid communication with wiper seal groove 144 through groove bottom 172. The distance from first groove side 168 to second groove side 170 is greater than the width of wiper seal 54, thereby allowing wiper seal 54 to shift between first groove side 168 and second groove side 170 as determined by the pressure within advance chamber 50*c* and retard chamber 52*c* as will be described in detail below.

Figure 11A:
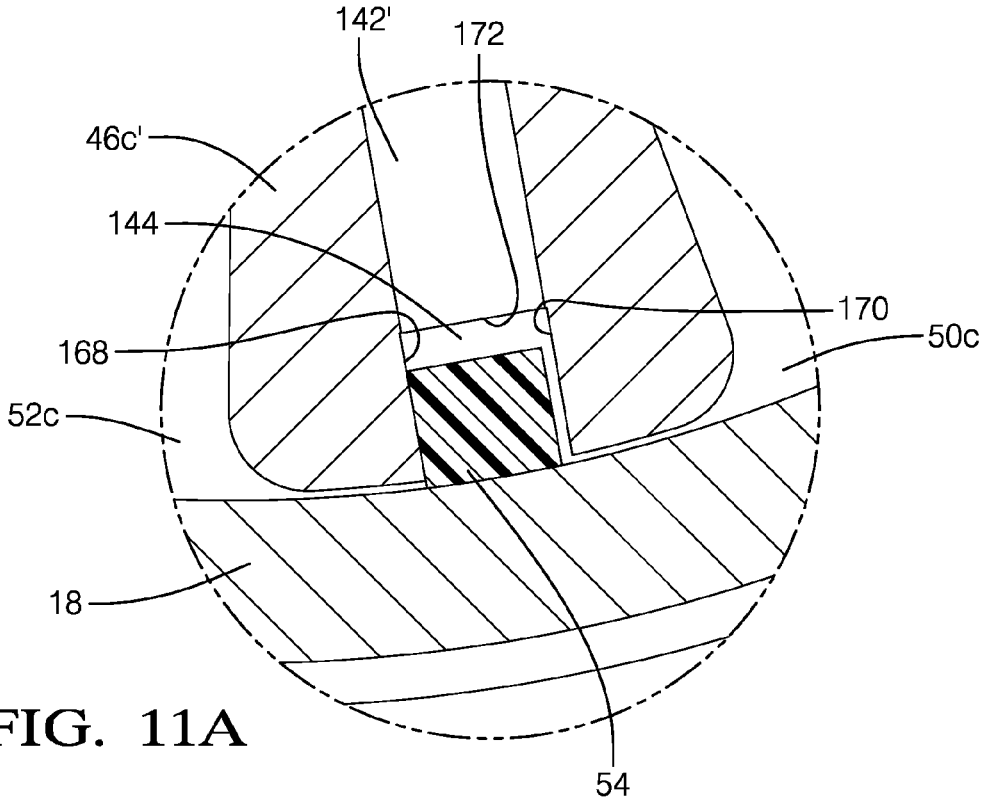
FIG. 11A is an enlarged view of a portion of FIG. 10 showing a wiper seal in a position for directing pressurized oil from an advance chamber to the lock pin oil control valve.

When phasing oil control valve 64 is operated to supply pressurized oil to advance chambers 50, pressurized oil within advance chamber 50*c* urges wiper seal 54 of vane 46*c*' away from second groove side 170 and against first groove side 168 of wiper seal groove 144, thereby allowing pressurized oil to be communicated between wiper seal 54 and second groove side 170 and between wiper seal 54 and groove bottom 172 from advance chamber 50*c* as shown in FIG. 11A. Consequently, the pressurized oil urges wiper seal 54 into contact with stator 18 to provide sealing therewith. Also consequently, the pressurized oil is supplied to lock pin valve supply passage 142'. From lock pin valve supply passage 142', the pressurized oil is supplied to lock pin oil control valve 34 in the same way as described above relative to camshaft phaser 12. Since wiper seal 54 is in contact with first groove side 168 and stator 18, pressurized oil is substantially prevented from being communicated from advance chamber 50*c* to retard chamber 52*c*.

Figure 11B:
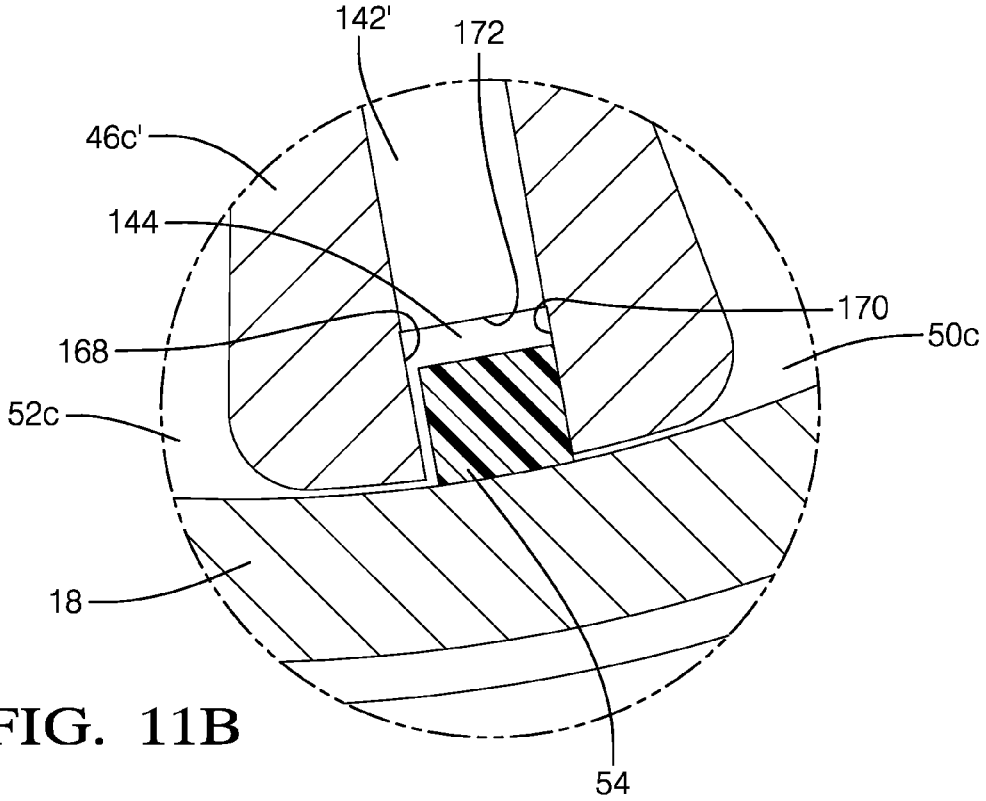
FIG. 11B is the enlarged view of FIG. 11A now showing the wiper seal in a position for directing pressurized oil from a retard chamber to the lock pin oil control valve.

Conversely, when phasing oil control valve 64 is operated to supply pressurized oil to retard chambers 52, pressurized oil within retard chamber 52*c* urges wiper seal 54 of vane 46*c*' away from first groove side 168 and against second groove side 170 of wiper seal groove 144, thereby allowing pressurized oil to be communicated between wiper seal 54 and first groove side 168 and between wiper seal 54 and groove bottom 172 from retard chamber 52*c* as shown in FIG. 11B. Consequently, the pressurized oil urges wiper seal 54 into contact with stator 18 to provide sealing therewith. Also consequently, the pressurized oil is supplied to lock pin valve supply passage 142'. From lock pin valve supply passage 142', the pressurized oil is supplied to lock pin oil control valve 34 in the same way as described above relative to camshaft phaser 12. Since wiper seal 54 is in contact with second groove side 170 and stator 18, pressurized oil is substantially prevented from being communicated from retard chamber 52*c* to advance chamber 50*c*.

Figure 11C:
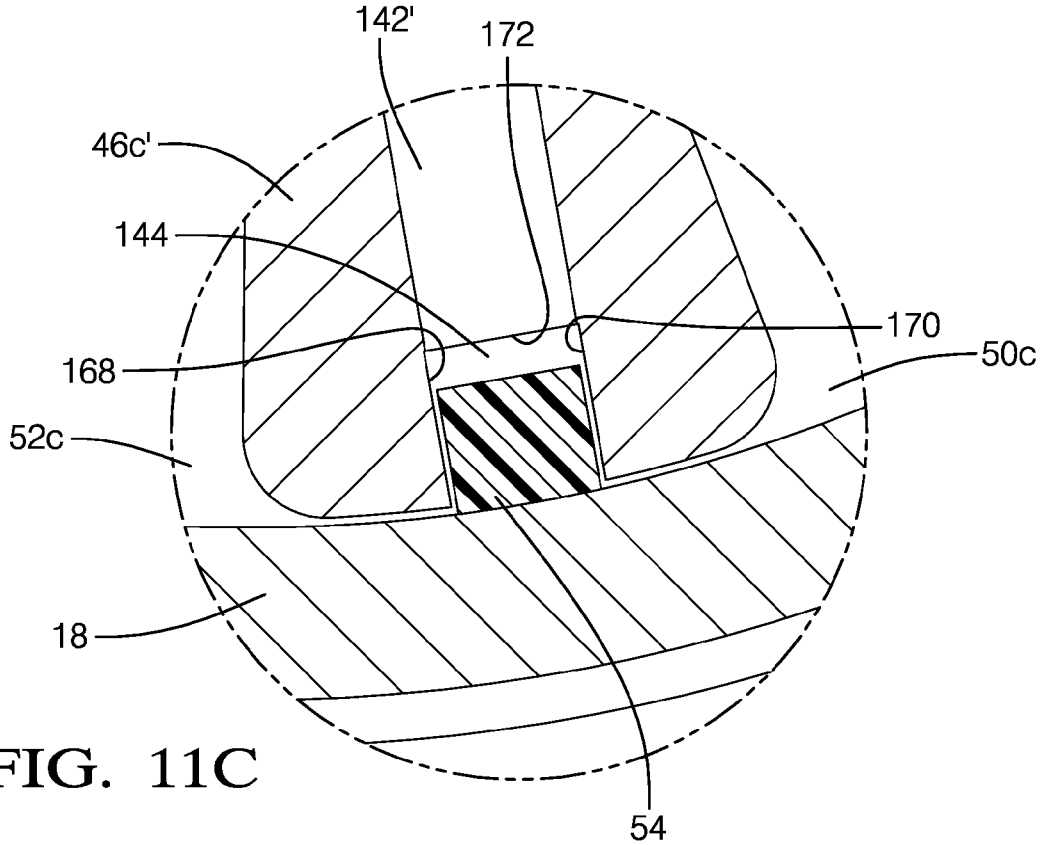
FIG. 11C is the enlarged view of FIGS. 11A and 11B now showing the wiper seal in a position for directing pressurized oil from both the advance chamber and the retard chamber to the lock pin oil control valve.

Pressurized oil may also be supplied to lock pin oil control valve 34 through lock pin valve supply passage 142' from both advance chamber 50*c* and retard chamber 52*c* simultaneously. This may occur when phasing oil control valve 64 is operated to supply pressurized oil to both advance chambers 50 and retard chambers 52 as described previously relative to the operation of phasing oil control valve 64. When pressurized oil is supplied to both advance chambers 50 and retard chambers 52, wiper seal 54 may become substantially centered within wiper seal groove 144 as shown in FIG. 11C. Consequently, pressurized oil may be communicated between wiper seal 54 and first groove side 168, between wiper seal 54 and second groove side 170, and between wiper seal 54 and groove bottom 172 from both advance chamber 50*c* and retard chamber 52*c*. As a result, the pressurized oil is supplied to lock pin valve supply passage 142'. From lock pin valve supply passage 142' the pressurized oil is supplied to lock pin oil control valve 34 in the same way as described above relative to camshaft phaser 12.

While this invention has been described in terms of preferred embodiments thereof, it is not intended to be so limited, but rather only to the extent set forth in the claims that follow.

We claim:

1. A camshaft phaser for use with an internal combustion engine for controllably varying the phase relationship between a crankshaft and a camshaft in said internal combustion engine, said camshaft phaser comprising:

a stator having a plurality of lobes and connectable to said crankshaft of said internal combustion engine to provide a fixed ratio of rotation between said stator and said crankshaft;

a rotor coaxially disposed within said stator, said rotor having a plurality of vanes interspersed with said lobes defining alternating advance chambers and retard chambers, wherein said advance chambers receive pressurized oil in order to change the phase relationship between said crankshaft and said camshaft in an advance direction and said retard chambers receive said pressurized oil in order to change the phase relationship between said camshaft and said crankshaft in a retard direction;

a lock pin disposed within one of said rotor and said stator for selective engagement with a lock pin seat for preventing a change in phase relationship between said rotor and said stator at a predetermined aligned position of said rotor relative to said stator; and a lock pin oil control valve within said camshaft phaser for 1) selectively receiving said pressurized oil from one of said advance chambers and directing said pressurized oil to said lock pin for disengaging said lock pin from said lock pin seat, 2) selectively receiving said pressurized oil from one of said retard chambers and directing said pressurized oil to said lock pin for disengaging said lock pin from said lock pin, and 3) venting said pressurized oil from said lock pin for engaging said lock pin with said lock pin seat.

2. A camshaft phaser as in claim 1 wherein one of said plurality of vanes comprises a lock pin valve supply passage therein which provides 1) selective fluid communication between said one of said advance chambers and said lock pin oil control valve and 2) selective fluid communication between said one of said retard chambers and said lock pin oil control valve.

3. A camshaft phaser as in claim 2 wherein:

said one of said plurality of vanes comprises a wiper seal groove in a radial tip thereof;

a wiper seal is disposed within said wiper seal groove for sealing between said one of said plurality of vanes and said stator;

said lock pin valve supply passage is in fluid communication with said wiper seal groove;

said pressurized oil within said one of said advance chambers moves said wiper seal within said wiper seal groove to provide fluid communication between said one of said advance chambers and said lock pin oil control valve through said wiper seal groove and said lock pin valve supply passage; and said pressurized oil within said one of said retard chambers moves said wiper seal within said wiper seal groove to provide fluid communication between said one of said retard chambers and said lock pin oil control valve through said wiper seal groove and said lock pin valve supply passage.

4. A camshaft phaser as in claim 3 wherein:

said wiper seal groove is defined by a first groove side, a second groove side opposing and facing toward said first groove side, and a groove bottom joining said first groove side and said second groove side;

said pressurized oil within said one of said advance chambers urges said wiper seal away from said second groove side to provide fluid communication between said one of said advance chambers and said lock pin oil control valve; and said pressurized oil within said one of said retard chambers urges said wiper seal away from said first groove side to provide fluid communication between said one of said retard chambers and said lock pin oil control valve.

5. A camshaft phaser as in claim 2 further comprising a shuttle valve which selectively provides fluid communication between 1) said one of said advance chambers and said lock pin valve supply passage and 2) said one of said retard chambers and said lock pin valve supply passage.

6. A camshaft phaser as in claim 5 wherein:

said shuttle valve is slidably located within a shuttle valve bore defined in said one of said plurality of vanes, said shuttle valve bore being in fluid communication with said lock pin valve supply passage;

said pressurized oil within said one of said advance chambers positions said shuttle valve within said shuttle valve bore to substantially prevent fluid communication between said one of said retard chambers and said lock pin valve supply passage; and said pressurized oil within said one of said retard chambers positions said shuttle valve within said shuttle valve bore to substantially prevent fluid communication between said one of said advance chambers and said lock pin valve supply passage.

7. A camshaft phaser as in claim 6 wherein said shuttle valve comprises:

a shuttle valve body extending along a shuttle valve axis and sized to provide clearance with said shuttle valve bore to allow said pressurized oil to flow between said shuttle valve body and said shuttle valve bore;

a shuttle valve oil controlling land extending radially outward from said shuttle valve body and sized to provide a close sliding fit with said shuttle valve bore to substantially prevent oil from passing between said shuttle valve oil controlling land and said shuttle valve bore, said shuttle valve oil controlling land selectively substantially preventing fluid communication between said one of said retard chambers and said lock pin valve supply passage and selectively substantially preventing fluid communication between said one of said advance chambers and said lock pin valve supply passage.

8. A camshaft phaser as in claim 7 wherein said shuttle valve further comprises a shuttle valve guiding land extending radially outward from said from said shuttle valve body and spaced axially from said shuttle valve oil controlling land, wherein said shuttle valve guiding land is sized to substantially prevent tipping of said shuttle valve within said shuttle valve bore while substantially not inhibiting axial movement of said shuttle valve within said shuttle valve bore, and wherein said shuttle valve guiding land includes a flow feature to allow said pressurized oil to pass by said shuttle valve guiding land within said shuttle valve bore.

9. A camshaft phaser as in claim 8 wherein said flow feature is a flat formed on an outside surface of said shuttle valve guiding land.

10. A camshaft phaser as in claim 6 wherein said shuttle valve bore extends axially through said one of said plurality of vanes from a first axial face of said rotor to a second axial face of said rotor.

11. A camshaft phaser as in claim 7 wherein said shuttle valve bore extends axially through said one of said plurality of vanes from a first axial face of said rotor to a second axial face of said rotor.

12. A camshaft phaser as in claim 11 wherein said one of said plurality of vanes comprises:

a first shuttle valve supply passage fluidly connecting said one of said advance chambers and said shuttle valve bore; and a second shuttle valve supply passage fluidly connecting said one of said retard chambers and said shuttle valve bore;

wherein said shuttle valve oil controlling land of said shuttle valve is between said first shuttle valve supply passage and said second shuttle valve supply passage.

13. A camshaft phaser as in claim 7 wherein:

said shuttle valve oil controlling land selectively substantially prevents said pressurized oil in said one of said advance chambers from being communicated to said one of said retard chambers; and said shuttle valve oil controlling land selectively substantially prevents said pressurized oil in said one of said retard chambers from being communicated to said one of said advance chambers.

14. A method for operating a camshaft phaser for use with an internal combustion engine for controllably varying the phase relationship between a crankshaft and a camshaft in said internal combustion engine, said camshaft phaser comprising a stator having a plurality of lobes and connectable to said crankshaft of said internal combustion engine to provide a fixed ratio of rotation between said stator and said crankshaft; a rotor coaxially disposed within said stator, said rotor having a plurality of vanes interspersed with said lobes defining alternating advance chambers and retard chambers, wherein said advance chambers receive pressurized oil in order to change the phase relationship between said crankshaft and said camshaft in an advance direction and said retard chambers receive said pressurized oil in order to change the phase relationship between said camshaft and said crankshaft in a retard direction; and a lock pin disposed within one of said rotor and said stator for selective engagement with a lock pin seat for preventing a change in phase relationship between said rotor and said stator at a predetermined aligned position of said rotor relative to said stator; and a lock pin oil control valve within said camshaft phaser for 1) selectively directing said pressurized oil to said lock pin for disengaging said lock pin from said lock pin seat, 2) selectively directing said pressurized oil to said lock pin for disengaging said lock pin from said lock pin, and 3) venting said pressurized oil from said lock pin for engaging said lock pin with said lock pin seat, said method comprising:

selectively supplying said pressurized oil to said lock pin oil control valve from one of said advance chambers; and selectively supplying said pressurized oil to said lock pin oil control valve from one of said retard chambers.

* * * * *